United States Patent [19]

Plumly

[11] Patent Number: 4,802,073

[45] Date of Patent: Jan. 31, 1989

[54] LIGHTING LEVEL CONTROL APPARATUS FOR FLUORESCENT LIGHTING INSTALLATIONS

[76] Inventor: George W. Plumly, 1386 C Crescent, D.C.B.E., Granbury, Tex. 76048

[21] Appl. No.: 151,887

[22] Filed: Feb. 3, 1988

[51] Int. Cl.[4] ..... F21V 23/04

[52] U.S. Cl. ..... 362/251; 362/221; 315/362; 315/DIG. 4

[58] Field of Search ..... 315/291, 362, DIG. 4; 362/217, 221, 251, 260

[56] References Cited

U.S. PATENT DOCUMENTS 4,001,571 1/1977 Martin ..... 362/221 X 4,686,427 8/1987 Burke ..... 315/DIG. 4

*Primary Examiner*—Stephen F. Husar

*Attorney, Agent, or Firm*—Arthur F. Zobal; Geoff Mantooth

[57] ABSTRACT

A fluorescent lighting installation incorporates a first switch device for applying and removing power from the installation and a plurality of second switch devices for providing plurality light levels. The respective second switch devices are located within respective ones of a plurality of selected fluorescent lighting fixtures and are interconnected with the respective power inputs, fluorescent lamps and ballasts of the respective selected fluorescent lighting fixtures. The respective second switch devices are operable to step through plural states to provide plural operating states for the fluorescent lamps in the selected fluorescent lighting fixtures. The second switch devices step from one state to the next in response to the application of power for an indefinite period of time by the first switch device.

14 Claims, 4 Drawing Sheets

LIGHTING LEVEL CONTROL APPARATUS FOR FLUORESCENT LIGHTING INSTALLATIONS

FIELD OF INVENTION

The present invention relates to fluorescent lighting installations incorporating means for providing plural lighting levels.

BACKGROUND OF THE INVENTION

In many situations where fluorescent lighting is used, it is desirable to provide plural levels of lighting. A typical example involves full level lighting during the day to provide sufficient light for work or task activities and some minimum level of lighting during the night after normal working hours. The night level provides sufficient light for security purposes and the like while saving energy with reduced lighting. Hallways in buildings provide an excellent application for such plural level lighting.

The most common prior art approach to providing plural levels of lighting involves wiring groups of fixtures into distinct circuits, with each circuit controlled by its own switch means. To obtain the desired level of lighting, the respective switch means are operated to energize and de-energize the desired circuits Because groups of fixtures are controlled, the fluorescent light tubes in any given fixture are either all on or all off. Other prior art approaches to providing plural levels of lighting in fluorescent lighting installations have involved complex control apparatus including a central controller means for controlling lamps in multiple zones and requiring extensive low voltage control wiring The prior art approaches of which I am aware are lacking in economy, simplicity and flexibility.

The objective of the present invention is to provide a selectable plural light level capability in fluorescent lighting installations in a manner that will achieve the goals of economy, simplicity and flexibility.

DESCRIPTION OF PREFERRED EMBODIMENT

Figure 1:
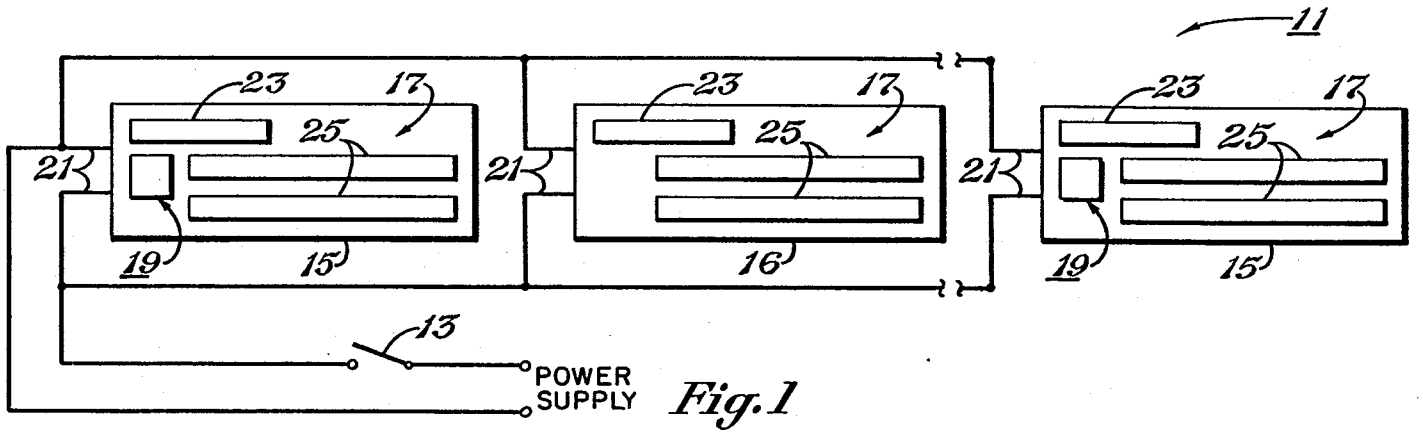
FIG. 1 is a schematic electrical circuit diagram showing a fluorescent lighting installation in accordance with a preferred embodiment of the present invention.

In FIG. 1, there is shown a schematic electrical circuit diagram of the fluorescent lighting installation 11 of the present invention, in accordance with a preferred embodiment. The fluorescent lighting installation 11 includes first switch means 13, a plurality of equipped fluorescent lighting fixtures 15, a plurality of unequipped fluorescent lighting fixtures 16, a plurality of illumination means 17, and a plurality of second switch means 19.

The first switch means 13 alternately applies and removes power from the fluorescent lighting installation 11 by connecting or disconnecting the power supply from the installation. The first switch means 13 may be either a manually operated switch as in, for example, a conventional wall switch, or a centrally located switch which may be either manual or automatic. Such a centrally located switch is typically for controlling all hallway lighting in a multi-floor building.

Each fluorescent lighting fixture (whether equipped or unequipped) 15, 16 has a pair of power input conductors 21 and illumination means 17. The illumination means 17 in each fluorescent lighting fixture 15, 16 includes at least one ballast 23 and a plurality of fluorescent lamps 25. The fluorescent lighting fixtures 15, 16 may have 2, 3, or 4 fluorescent lamps. In a two lamp fluorescent lighting fixture, the two fluorescent lamps 25 are connected to a single ballast 23 (see FIG. 2). In a four lamp fluorescent lighting fixture, two of the fluorescent lamps are connected to a first ballast A and the other two fluorescent lamps are connected to a second ballast B (see FIG. 4). In a three lamp fluorescent lighting fixture (not shown), two of the fluorescent lamps are connected to a first ballast and the other fluorescent lamp is connected to a second ballast.

Figure 4:
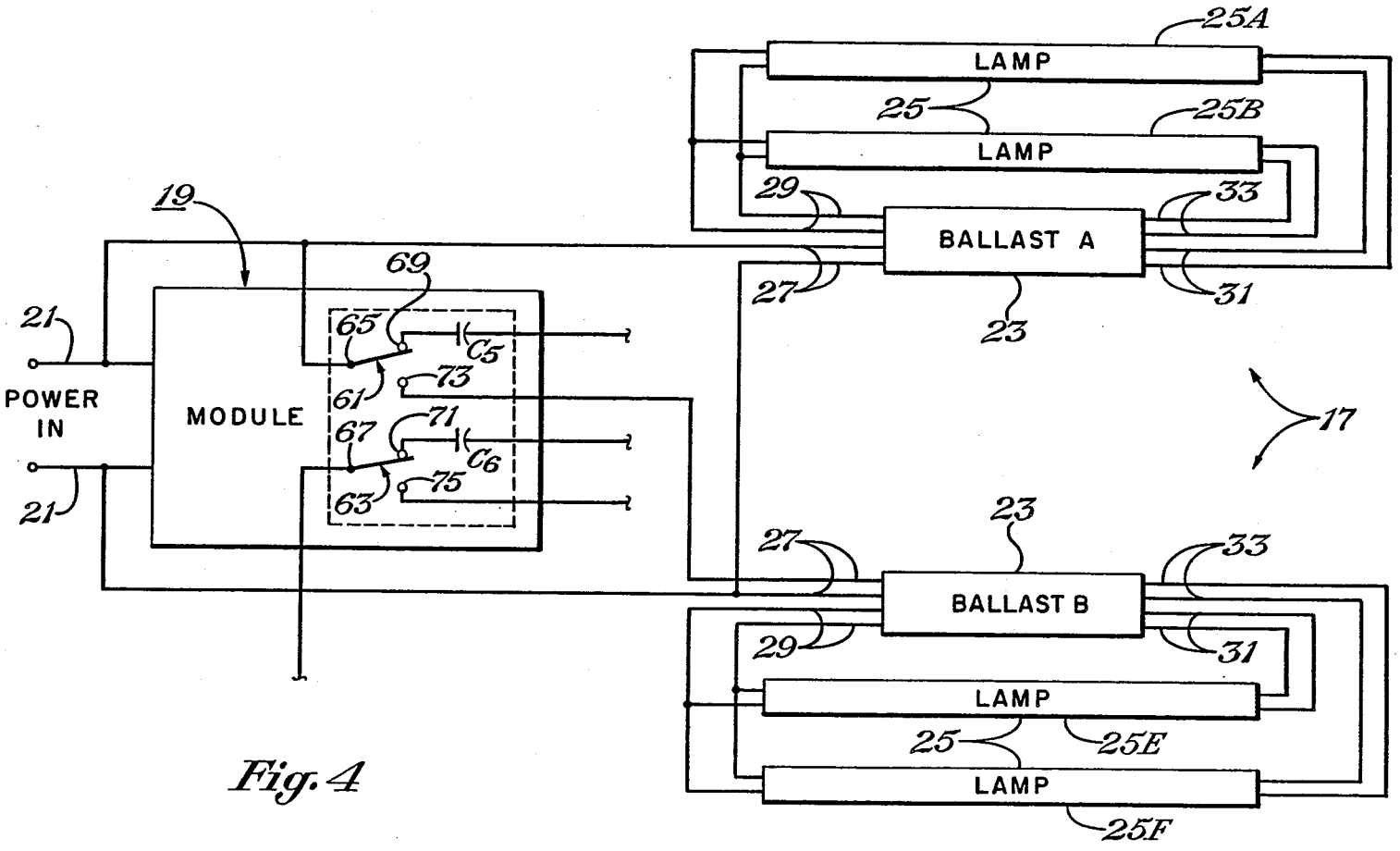
FIG. 4 is a schematic circuit diagram showing the electrical connections in a four lamp fluorescent lighting fixture of the fluorescent lighting installation of the present invention, in accordance with a preferred embodiment.

The electrical connections between the respective fluorescent lamps 25 and the respective ballasts 23 in a conventional fluorescent lighting fixture are made with color-coded wires. Referring to FIG. 4, the electrical connections between the ballast A and the fluorescent lamps 25A, 25B are exemplary of the wiring involved in a plural lamp fluorescent lighting fixture. The ballast A has four pairs of wires: a black and white pair 27, a yellow pair 29, a blue pair 31, and a red pair 33. The black and white pair 27 is connected to the power input conductors 21, and the yellow pair 29 is connected to both fluorescent lamps 25A, 25B such that the lamp filaments (not shown) at one of the respective ends of both fluorescent lamps are connected in parallel to one another The blue pair of wires 31 is connected to a lamp filament at the other end of one of the fluorescent lamps 25A. The red pair of wires 33 is connected to a lamp filament at the other end of the other one of the fluorescent lamps 25B.

Figure 5:
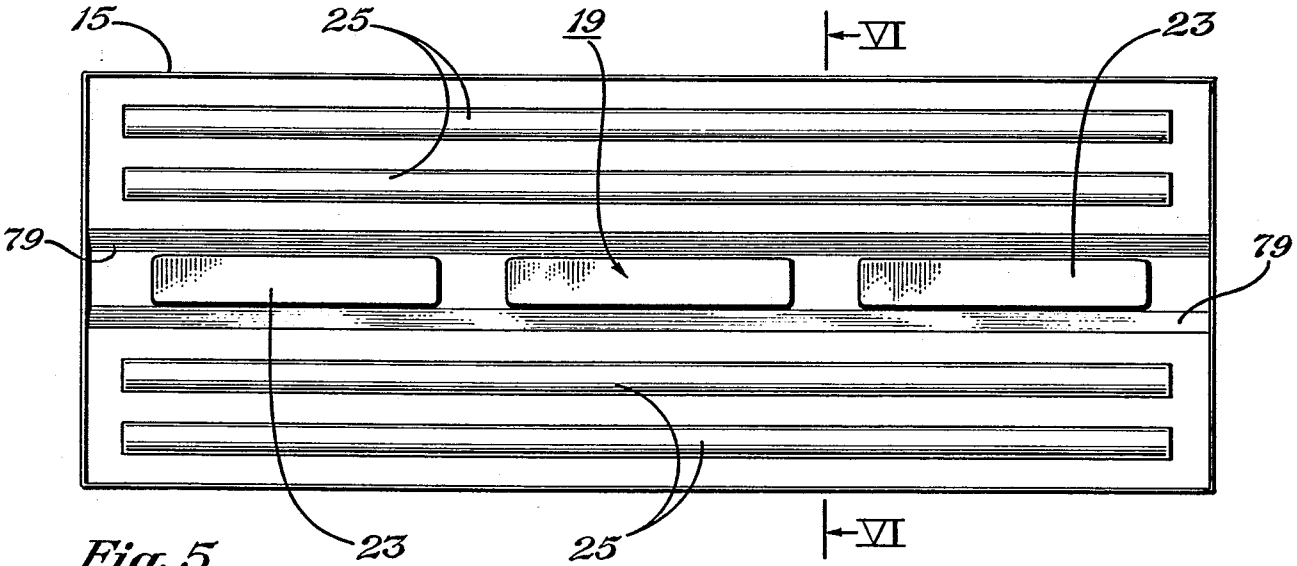
FIG. 5 is a schematic bottom plan view of a four lamp fluorescent lighting fixture, where the bottom wireway cover has been removed to illustrate the location of an installed second switch means.
Figure 6:
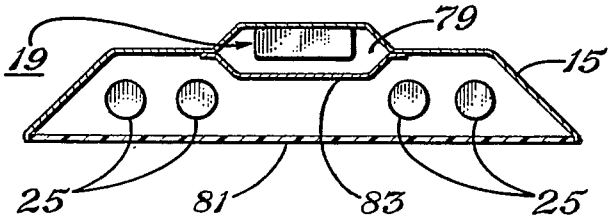
FIG. 6 is a schematic cross-sectional view of the fluorescent lighting fixture of FIG. 5, taken at lines VI—VI, showing the bottom wireway cover installed.

The individual second switch means 19 are interconnected with the respective power input conductors 21 and the respective ballasts 23 and fluorescent lamps 25 (see FIGS. 2 and 4) in a plurality of selected fluorescent lighting fixtures 15, which said interconnections will be described in more detail hereinafter. The selected fluorescent lighting fixtures are denominated equipped fixtures 15, while the fluorescent lighting fixtures that do not have a second switch means are denominated unequipped fixtures 16. Each fluorescent lighting fixture has a conventional enclosed wireway 79 that contains the ballasts 23 (see FIGS. 5 and 6). The wireway 79 is accessed by the removal of the translucent bottom fixture cover 81 and the bottom wireway cover 83. Each second switch means 19 is contained within a module that is located within the wireway 79 of a respective equipped fixture 15, so as to be wholly disposed within that fixture.

Each second switch means 19 is operable to step through plural states to provide plural operating states for the fluorescent lamps 25 in the equipped fixtures 15. The stepping of each second switch means 19 through plural states is in response to the application of power for an indefinite period of time by the first switch means 13.

In the preferred embodiment, the second switch means 19 steps between first and second states to provide corresponding first and second operating states for the fluorescent lamps 25 in the equipped fixtures 15. In their first operating state, the fluorescent lamps in the equipped fixtures 15 operate in either one of three modes: full brilliance, less than full brilliance (or dim), or off. In their second operating state, all of the fluorescent lamps in the equipped fixtures 15 operate at full brilliance.

The manner of interconnection of the second switch means 19 to the power input conductors 21, ballast 23, and fluorescent lamps 25 of an equipped fixture 15 determines the particular first operating state mode of the fluorescent lamps in the equipped fixture. Once the second switch means 19 is wired into an equipped fixture 15 for a particular first operating state mode, the respective fluorescent lamps will, whenever they are in the first operating state, always operate in that particular mode. The particular first operating state mode of the fluorescent lamps in an equipped fixture can be changed by rewiring the respective second switch means.

In the simplest application, the operating states of the fluorescent lamps in all of the equipped fixtures are synchronized such that all of the fluorescent lamps operate in the first operating state at the same time. To reach the first operating state from the situation where power is applied to the fluorescent lighting installation, the first switch means 13 is operated to first remove power from the fluorescent lighting installation 11 and turn the fluorescent lamps 25 off and then to reapply power, wherein all of the second switch means 19 step to the next state, which for this example will be the first state, and the fluorescent lamps enter into the corresponding first operating state. Then the first switch means 13 is again operated to first remove power from the fluorescent lighting installation 11 and then to reapply power, wherein all of the second switch means 19 step to the second state and the fluorescent lamps enter into the second operating state. The cycle is repeated by operating the first switch means 13. Each second switch means 19 has set means for synchronizing the operating states of the fluorescent lamps in the equipped fixtures, when the second switch means are installed in the fluorescent lighting fixtures.

Figure 3:
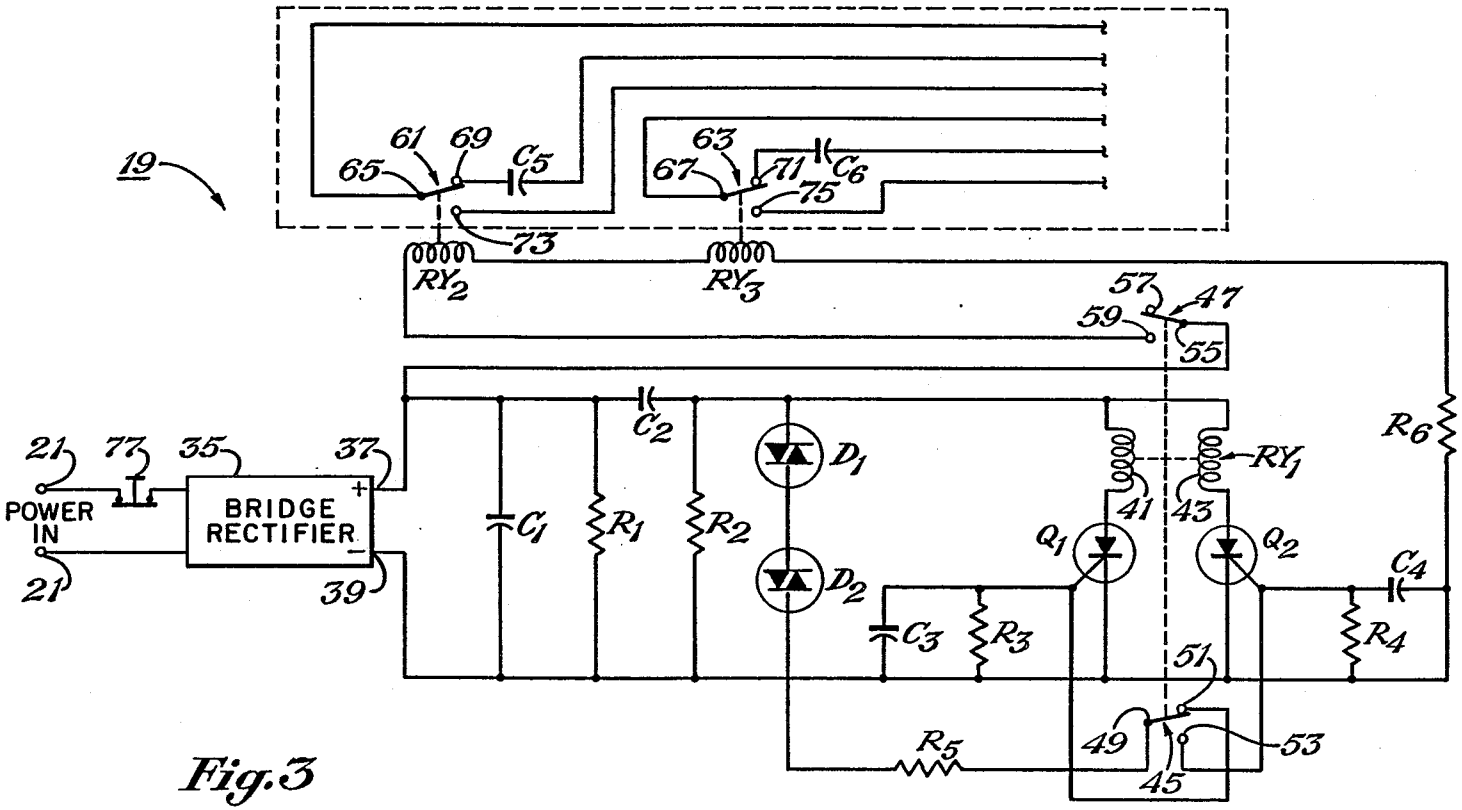
FIG. 3 is a schematic electrical circuit diagram showing a second switching means to be utilized in a fluorescent lighting installation of the present invention, in accordance with a preferred embodiment.

The preferred embodiment of the second switch means 19 will now be described with reference to FIG. 3 which shows the electronic components and circuitry of the second switch means. The second switch means 19 is made up of a rectifier portion, a stepping portion, and a switching portion.

The rectifier portion includes a bridge rectifier 35 and a filter capacitor $C_1$. The input of the bridge rectifier is connected to the power input conductors 21. The bridge rectifier 35 converts the ac that is provided at the power input conductors 21 into dc which is provided to the positive and ground bridge rectifier outputs 37, 39. The filter capacitor $C_1$ is connected across the outputs of the bridge rectifier 35. A bleeder resistor $R_1$ is connected in parallel to the filter capacitor $C_1$ to bleed off voltage from the filter capacitor once power is removed by the first switch means 13.

The stepping portion includes a latching relay $RY_1$, a pair of silicon controlled rectifiers $Q_1$, $Q_2$, and diacs $D_1$, $D_2$. The latching relay $RY_1$ has a set coil 41, a reset coil 43, and a double-pole, double-throw switch which is made up of a first latching relay switch portion 45 and a second latching relay switch portion 47. The first latching relay switch portion 45 has a common contact 49 and first and second contacts 51, 53; the second latching relay 47 also has a common contact 55 and first and second contacts 57, 59. One end of the respective set and reset coils 41, 43 is connected to the bridge rectifier positive output 37 through a dc blocking capacitor $C_2$. A bleeder resistor $R_2$ connects the negative terminal of the blocking capacitor $C_2$ to ground 39. The other end of the respective set and reset coils 41, 43 is connected to ground 39 through the respective set and reset silicon controlled rectifiers $Q_1$, $Q_2$. The respective gates of the set and reset silicon controlled rectifiers $Q_1$, $Q_2$ are connected to the respective first and second contacts 51, 53 of the first latching relay switch portion 45. The respective gates of the set and reset silicon controlled rectifiers $Q_1$, $Q_2$ are also connected to ground through stabilizing capacitors $C_3$, $C_4$ and bleeder resistors $R_3$, $R_4$. The diacs $D_1$, $D_2$ are connected in series to one another and between the bridge rectifier positive output, through the blocking capacitor $C_2$, and the common contact 49 of the first latching relay switch portion 45. A current limiting resistor $R_5$ is connected in series with the diacs $D_1$,$D2$. The common contact 55 of the second latching relay switch portion 47 is connected to the positive output 37 of the bridge rectifier 35.

The switching portion includes first and second switching relays $RY_2$, $RY_3$ and dimming capacitors $C_5$, $C_6$. The coils of the first and second switching relays $RY_2$, $RY_3$ are connected together in series and to the second contact 59 of the second latching relay switch portion 47. A current limiting resistor $R_6$ in series with the coils of the first and second switching relays $RY_2$, $RY_3$ connects the coils to ground. The respective first and second switching relays $RY_2$, $RY_3$ have respective first and second single-pole, double-throw switches 61, 63 having respective common contacts 65, 67, first contacts 69, 71, and second contacts 73, 75. Respective dimming capacitors $C_5$, $C_6$ are connected to the respective first contacts 69, 71 of the respective first and second switching relay switches 61, 63.

The interconnection of the second switch means 19 with the power input conductors 21 and the illumination means 17 will now be described. The manner of interconnecting the second switch means 19 depends on the mode of operation that is desired for the fluorescent lamps 25 in the first operating state in that particular lighting fixture. As discussed hereinbefore, the second switch means 19 steps between first and second states to provide first and second operating states for the fluorescent lamps in the equipped fixtures 15. In their first operating state, the fluorescent lamps in the equipped fixtures operate in either one of three modes: full brilliance, dim, or off.

Figure 2:
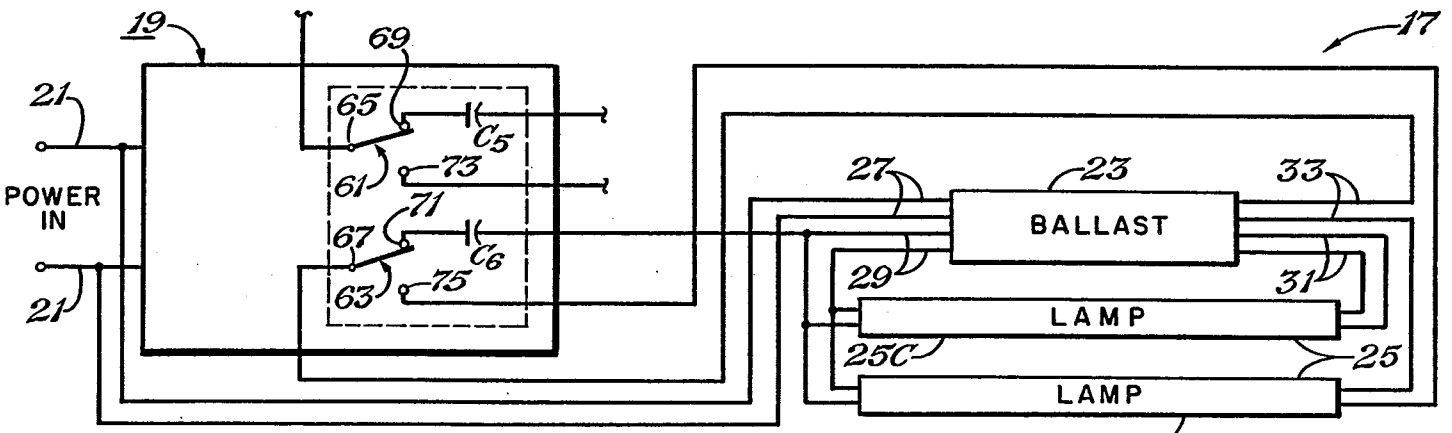
FIG. 2 is a schematic circuit diagram showing the electrical connections in a two lamp fluorescent lighting fixture of the fluorescent lighting installation of the present invention, in accordance with a preferred embodiment.

The interconnection of the second switch means 19 with the power input conductors 21 and the illumination means 17 for the dim mode of the fluorescent lamp first operating state will first be described, with reference to FIG. 2. The black and white pair of wires 27 from the ballast 23 is connected to the power input conductors 21. The yellow pair of wires 29 from the ballast 23 is connected to both fluorescent lamps 25C, 25D in the conventional manner. The blue pair of wires 31 from the ballast 23 is connected to one of the fluorescent lamps 25C. One of the red wires 33 is connected to the other of the fluorescent lamps 25D. The other red wire 33 is connected to the common contact 67 of the second switching relay switch 63. The first contact 71 of the second switching relay switch 63 is connected, through the dimming capacitor $C_6$, to one of the yellow wires 29. The second contact 75 of the second switching relay switch 63 is connected to the other of the fluorescent lamps 25D.

The first switching relay switch 61 is left unconnected in the two lamp fluorescent lighting fixture. Two switching relay switches 61, 63 are provided in the preferred embodiment of the second switch means 19 to allow the interconnection of the second switch means to both ballasts in a three or four lamp fluorescent lighting fixture. Thus, in a two lamp fluorescent lighting fixture, such as is shown in FIG. 2, either of the switching relay switches may be utilized, with the second switching relay switch 63 being arbitrarily selected above.

The operation of the fluorescent lighting installation 11 of the present invention will now be described, with reference to the two lamp fluorescent lighting fixture of FIG. 2 and to FIGS. 1 and 3. Power is applied to the fluorescent lighting installation 11 by closing the first switch means 13. In the unequipped fluorescent lighting fixtures 16, the fluorescent lamps and ballasts are conventionally wired. Thus, whenever power is applied to the fluorescent lighting installation 11 by the first switch means 13, the fluorescent lamps in the unequipped fixtures 16 operate at full brilliance.

In the equipped fixtures 15, the application of power causes the second switch means 19 to step to the next state, which for this example will be the second state, wherein the first and second switching relay switches 61, 63 move to their respective second contacts 73, 75. With the second switch means 19 in the second state, the fluorescent lamps 25C, 25D are in the second operating state and operate at full brilliance. The operation of the second switch means 19 stepping to the second state is as follows: Upon the closing of the first switch means 13, the bridge rectifier 35 passes the transient resulting from the abrupt application of power. The transient passes across the dc blocking capacitor C2 where it causes the diacs $D_1$, $D_2$ to conduct. The transient continues on across the first latching relay switch portion 45 to the gate of the set silicon controlled rectifier $Q_1$, where it triggers the set silicon controlled rectifier $Q_1$ into a conductive state. The set coil 41 is energized momentarily, wherein the first and second latching relay switch portions 45, 47 are thrown to their respective second contacts 53, 59. The set silicon controlled rectifier $Q_1$ is turned off, de-energizing the set coil 41, but leaving the first and second latching relay switch portions 45, 47 in position against the second contacts 53, 59. The reset coil 43 is not energized because by this time the blocking capacitor $C_2$ has gone into its blocking mode. The stabilizing capacitors $C_3$, $C_4$ prevent multiple triggers of the set and reset silicon controlled rectifiers $Q_1$, $Q_2$. The second latching relay switch portion 47 connects the coils the first and second switching relays $RY_2$, $RY_3$ to the power supply. First and second switching relay switches 61, 63 move to their respective second contacts 73, 75. In this second state, the second switch means 19 is electrically invisible to the illumination means 17 and the fluorescent lamps 25C, 25D operate at full brilliance.

The operating state of the fluorescent lamps 25 is changed by operating the first switch means 13 to first remove power from the fluorescent lighting installation wherein all of the fluorescent lamps in the equipped and unequipped fluorescent lighting fixtures 15, 16 are off). and then reapply power. The application of power by the first switch means 13 causes the second switch means 19 to step to the next state, which is the first state, wherein the first and second relay switches 61, 63 move to their respective first contacts 69, 71. With the second switch means 19 in the first state, the fluorescent lamps 25C, 25D are in the first operating state, wherein one of the fluorescent lamps 25C operates at dim brilliance and the other of the fluorescent lamps 25D is off. The operation of the second switch means 19 stepping to the first states is as follows: Upon the application of power, the reset coil 43 of the latching relay $RY_1$ is energized (in the same way as the energization of the set coil) and throws the first and second latching relay switch portions 45, 47 to the respective first contacts 51, 57. The first and second switching relays $RY_2$, $RY_3$ are de-energized and the first and second switching relay switches 61, 63 are thrown back to their respective first contacts 69, 71, wherein the dimming capacitor $C_6$ is electrically substituted for one of the fluorescent lamps 25D so as to be placed electrically in parallel with the other fluorescent lamps 25C. The substituted fluorescent lamp 25D is off while the other fluorescent lamp 25C, that is the fluorescent lamp that is connected to the blue pair of wires 31, operates at less than full, or dim, brilliance.

The level of dimness of the operating fluorescent lamp 25C is determined by the value of the dimming capacitor $C_6$. For example, the operating fluorescent lamp 25C will operate at some level of dimness with a dimming capacitor $C_6$ value of 2.2 microfarads. The operating fluorescent lamp 25C will operate at full brilliance with a dimming capacitor $C_6$ value of 10–12 microfarads.

Referring now to Ballast A of FIG. 4, the interconnection of the second switch means 19 with the power input conductors 21 and the illumination means 17 for the full brilliance mode of the fluorescent lamp first operating state will be described. To provide for the full brilliance mode, the second switch means 19 is bypassed completely: the black and white pair of wires 27 from Ballast A is connected to the power input conductors 21, and the yellow, blue, and red pairs of wires 29, 31, 33 are connected directly to the fluorescent lamps 25A, 25B. The first and second operating states of the fluorescent lamps 25A, 25B are the same. Thus, regardless of what state the second switch means 19 is in, the fluorescent lamps 25A, 25B will operate at full brilliance, whenever power is applied to the fluorescent lighting installation 11 by the first switch means 13.

The interconnection of the second switch means 19 with the power conductors 21 and the illumination means 17, for the off mode of the fluorescent lamp first operating state will now be described with reference to Ballast B of FIG. 4. The black and white pair of wires 27 of Ballast B is connected to the power input conductors 21 through the second switch means 19. The black wire is connected to the second contact 73 of the first switching relay switch power input conductors. The common contact 65 of the first switching relay switch 61 is connected to the other of the power conductors. The yellow, blue, and red pairs of wires 29, 31, 33 are connected directly to the fluorescent lamps 25 as previously described. In the first state of the second switch means 19, the first switching relay switch 61 is on the first contact 69 and the fluorescent lamps associated with Ballast B are off. In the second state of the second switch means 19, the first switching relay switch 61 is on the second contact 73 and the fluorescent lamps associated with Ballast B are on.

Hallways are good examples of the application of the fluorescent lighting installation of the present invention. During working hours, full level lighting is typically provided in hallways, while after working hours some minimal level of lighting is provided in the same hallways. The lighting configuration for a particular hallway, where second switch means have been installed in the fluorescent lighting fixtures, might involve some fixtures wired for the fluorescent lamp first operating state off mode, some fixtures wired for the dim mode, and some fixtures wired for the full mode. If all of the fluorescent lamps in a particular fixture are to operate in the first operating state full mode, then the same lighting results can be achieved by not equipping the fluorescent lighting fixture with a second switch means. Thus, depending on the desired lighting configuration, the fluorescent lighting installation of the present invention may or may not include unequipped fixtures. Upon the application of power by the first switch means to the fluorescent lighting installation in the hallway, the respective second switch means step to the next state. If this next state is the second state, then all of the fluorescent lamps in the hallway will operate at full brilliance. If this next state is the first state however, then the fluorescent lamps in those fixtures wired for the off mode will be off, the fluorescent lamps in those fixtures wired for the dim mode will be dimmed, and the fluorescent lamps in those fixtures wired for the full mode, as well as the fluorescent lamps in unequipped fixtures, will operate at full brilliance.

Each second switch means 19 has a set means for synchronizing the operating states of the fluorescent lamps in an equipped fixture to the operating state of the fluorescent lamps in other equipped fixtures. The set means is in the form of a normally closed switch 77 located on one of the input conductors to the bridge rectifier 35 (see FIG. 3). Upon installation of second switch means 19 in the fixtures of the fluorescent lighting installation 11, the individual set means switches 77 may be actuated to synchronize the operating states of the fluorescent lamps in the equipped fixtures to the desired configuration. To synchronize operating states, power is first applied to the fluorescent lighting installation 11 through the first switch means 13. Then the individual set means switches 77 are actuated one or more times until the desired operating state is reached. The set means switch 77 interrupts the input power causing the stepping portion of the second switch means 19 to step through successive states.

The second switch means 19 may be used with either 115 Vac or 277 Vac power supplies. A voltage divider may be used in the second switch means 19 to achieve a voltage that is compatible with the various components that make up the second switch means.

The fluorescent lighting installation of the present invention has a selectable plural light level capability that achieves the aforementioned goals of economy, simplicity, and flexibility.

An important aspect of the present invention is that the fluorescent lighting installation can be more economically operated than prior art fluorescent lighting installations because of the provision of plural light levels wherein the light levels of individual fluorescent lighting fixtures are controlled. Thus, a sufficient amount of light can be provided for each of the plural lighting requirements in areas such as hallways. Changing from one light level to another is achieved by the application of power for an indefinite period of time.

Another aspect of the present invention is that, because the second switch means is installed in individual fluorescent lighting fixtures, there is flexibility to tailor a lighting configuration to the requirements of a particular situation. The second switch means can be retrofitted into existing fluorescent lighting installations or can be installed in conjunction with new fluorescent lighting installations.

Another aspect of the present invention is simplicity of installation and of use. The second switch means is electrically installed by interconnection to the power inputs and the illumination means. The lighting level is changed merely by operating conventional first switch means.

The foregoing disclosure and the showings made in the drawings are merely illustrative of the principles of this invention and are not to be interpreted in a limiting sense.

I claim:

1. In a fluorescent lighting installation having a first switch means for applying and removing power from said installation, and a plurality of fluorescent lighting fixtures, with each of said fixtures having a power input and illumination means which includes a plurality of fluorescent lamps; the improvement comprising a plurality of second switch means interconnected with respective said power inputs and respective said illumination means, with each of said second switch means being wholly disposed within respective ones of a plurality of selected fluorescent lighting fixtures denominated equipped fixtures, said second switch means for controlling the light level of said installation, with each of said second switch means in said equipped fixtures being operable to step through plural states to provide plural operating states for said fluorescent lamps in said equipped fixtures, said stepping from one state to the next state being responsive to the application of power for an indefinite period of time by said first switch means through the respective power input, whereby said stepping of a respective second switch means from one state to the next state provides the selected operating state for said fluorescent lamps.

2. The installation of claim 1 wherein, in one of said operating states, one or more of said fluorescent lamps in one or more selected equipped fixtures are disconnected from said power input by respective said second switch means.

3. The installation of claim 1 wherein, in one of said operating states, a capacitor is substituted for one of said fluorescent lamps in one or more respective selected equipped fixtures by a respective said second switch means such that said capacitor is placed electrically in parallel with an other fluorescent lamp, whereby said other fluorescent lamp operates at some level of brilliance.

4. The installation of claim 2 wherein, in one of said operating states, a capacitor is substituted for one of said fluorescent lamps in one or more respective selected equipped fixtures by a respective said second switch means such that said capacitor is placed electrically in parallel with an other fluorescent lamp, whereby said other fluorescent lamp operates at some level of brilliance.

5. The installation of claim 3 wherein in said selected equipped fixtures having a capacitor placed electrically in parallel with said other fluorescent lamp, said capacitor is of such a value so that said other fluorescent lamp operates at less than full brilliance.

6. The installation of claim 4 wherein in said selected equipped fixtures having a capacitor placed electrically in parallel with said other fluorescent lamp, said capacitor is of such a value so that said other fluorescent lamp operates at less than full brilliance.

7. The installation of claim 2 wherein, in one of said operating states, one or more of said fluorescent lamps in one or more selected equipped fixtures operate at full brilliance.

8. The installation of claim 3 wherein, in one of said operating states, one or more of said fluorescent lamps in one or more selected equipped fixtures operate at full brilliance.

9. The installation of claim 4 wherein, in one of said operating states, one or more of said fluorescent lamps in one or more selected equipped fixtures operate at full brilliance.

10. The installation of claim 6 wherein, in one of said operating states, one or more of said fluorescent lamps in one or more selected equipped fixtures operate at full brilliance.

11. The installation of claim 1 wherein each of said second switch means includes set means for setting said second switch means to an initial operating state, whereby, upon installation of said second switch means in said fluorescent lighting installation, the operating states of said fluorescent lamps in said equipped fixtures can by synchronized by operating said set means so as to set all of said second switch means to the initial operating state.

12. The installation of claim 2 wherein each of said second switch means includes set means for setting said second switch means to an initial operating state, whereby, upon installation of said second switch means in said fluorescent lighting installation, the operating states of said fluorescent lamps in said equipped fixtures can be synchronized by operating said set means so as to set all of said second switch means to the initial operating state.

13. The installation of claim 3 wherein each of said second switch means includes set means for setting said second switch means to an initial operating state, whereby, upon installation of said second switch means in said fluorescent lighting installation, the operating states of said fluorescent lamps in said equipped fixtures can be synchronized by operating said set means so as to set all of said second switch means to the initial operating state.

14. The installation of claim 9 wherein each of said second switch means includes set means for setting said second switch means to an initial operating state, whereby, upon installation of said second switch means in said fluorescent lighting installation, the operating states of said fluorescent lamps in said equipped fixtures can be synchronized by operating said set means so as to set all of said second switch means to the initial operating state.

* * * * *